United States Patent [19]

Marton

[11] 3,935,678

[45] Feb. 3, 1976

[54] VACUUM ATTACHMENT FOR ABRADING MACHINE

[76] Inventor: Miksa Marton, 3620 Rankin St., Windsor, Ontario, Canada

[22] Filed: Nov. 18, 1974

[21] Appl. No.: 524,799

Related U.S. Application Data

[63] Continuation of Ser. No. 304,412, Nov. 7, 1972, abandoned.

[30] Foreign Application Priority Data

Aug. 2, 1972 Canada ..... 148535

[52] U.S. Cl. ..... 51/170 T; 51/273

[51] Int. Cl.² ..... B24B 23/02; B24B 55/06

[58] Field of Search ..... 51/273, 177, 170 T, 174; 15/385, 398, 399, 320

[56] References Cited

UNITED STATES PATENTS

| | | | |
|---|---|---|---|
| 2,250,177 | 7/1941 | Boccasile | 15/320 |
| 3,375,540 | 4/1968 | Hyde | 15/320 |
| 3,468,076 | 9/1969 | Jones | 51/273 |
| 3,673,744 | 7/1972 | Oimoen | 51/177 |
| 3,686,707 | 8/1972 | Hughes et al. | 15/320 |
| 3,826,045 | 7/1974 | Champayne | 51/273 |

FOREIGN PATENTS OR APPLICATIONS

| | | | |
|---|---|---|---|
| 1,085,064 | 12/1960 | Germany | 51/177 |

*Primary Examiner*—Al Lawrence Smith
*Assistant Examiner*—Nicholas P. Godici
*Attorney, Agent, or Firm*—Cushman, Darby & Cushman

[57] ABSTRACT

This invention relates to a vacuum attachment for an abrading machine wherein the vacuum is applied through a vacuum chamber having vacuum directing means close to the workpiece being abraded. The vacuum chamber is preferably adapted for movement relative to the abrader.

19 Claims, 5 Drawing Figures

VACUUM ATTACHMENT FOR ABRADING MACHINE

This is a continuation of application Ser. No. 304,412 filed Nov. 7, 1972, and now abandoned.

This invention relates to an attachment for an abrading machine adapted to remove abraded material from a workpiece during an abrading operation. The invention more specifically relates to an attachment comprised of a vacuum chamber and a vacuum chamber support means, the vacuum chamber support means being adapted to support the vacuum chamber near the surface of the workpiece and abrading face of the abrader to direct a partial vacuum onto the working surface. In a further embodiment of the invention confining means are associated with the attachment to contain the abraded material and physically rub the abraded surface.

In sanding, grinding and other abrading operations it is desirable to remove the abraded material as soon as it is abraded so that on the subsequent pass of the abrader the abrader will be working on the surface to be abraded which is as clear as possible of the abraded material loosened on the prior pass.

It is also desirable to confine the abraded material so that the operator will not be struck by abraded material. Further advantages of confining the abraded material are that the atmosphere in which the men are working is improved and the workmen may view the surface of the workpiece on which they are carrying out the abrading operation. The area of the workpiece should be as free as possible of the previously abraded material whether such material be in the air or on the surface just abraded.

The attachment of this invention when applied to a sander, grinder or other abrading tool removes the abraded material from the workpiece by a vacuum applied through a vacuum chamber which is maintained just above the surface being abraded. In another aspect the attachment includes means for confining the abraded material. By confining the abraded material and maintaining the vacuum chamber having vacuum directing means close to the workpiece the abraded material can be removed as soon as the abraded material is free of the abrader.

In another embodiment the vacuum chamber is supported for movement relative to the abrader. Because of the relative movement between the vacuum chamber and the abrader the vacuum directing means associated with the abrader will direct a partial vacuum on the surface of the workpiece proximate the abrader when abrading workpieces having flat or curved surfaces.

The confining means may be comprised of a series of bristles which are applied to the vacuum chamber and actually brush the surface as the abrader is being used.

In describing this invention, reference is had to the accompanying drawings in which like characters designate corresponding parts in all the views.

Figure 1:
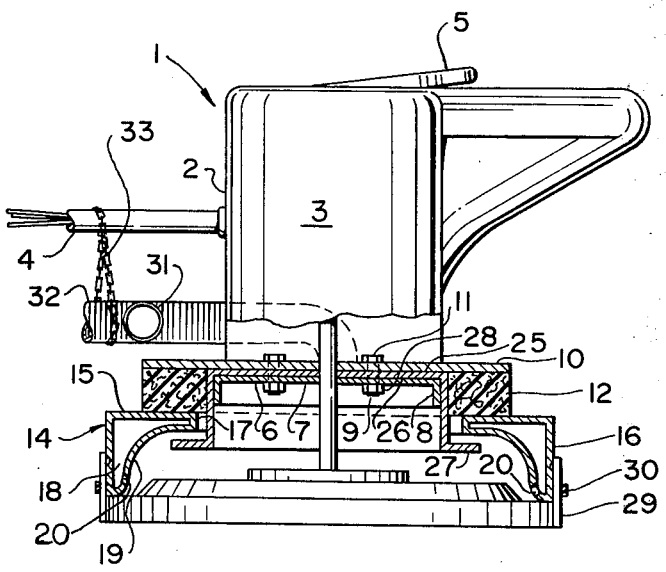
FIG. 1 is a side elevation cross-sectional view through the bottom portion of the sander and one embodiment of the attachment.

Referring to FIG. 1 there is shown a sander 1. The sander 1 is comprised of a shell 2 containing a motor 3, power conduit 4 and starter 5. The base of shell 2 is closed by a base plate 6 comprised of a flat portion 7 terminating in downwardly extending flanges 8. The plate 6 is retained on shell 2 by four bolts 9.

In order to apply the attachment to the sander 1 the bolts 9 and plate 6 are removed. A flat upper retaining plate 10 having bolt holes 11 to receive bolts 9 is applied to the bottom of shell 2 with the bolt holes 11 lined up so that bolts 9 are insertable through upper retaining plate 10 into the shell 2.

A circular foam rubber ring 12 having an outer diameter 13 substantially equal to the diameter of flat upper retaining plate 10 is applied against the flat upper retaining plate 10. The inner diameter of foam rubber ring 12 is slightly greater than the outer diameter of base plate 6.

Figure 4:
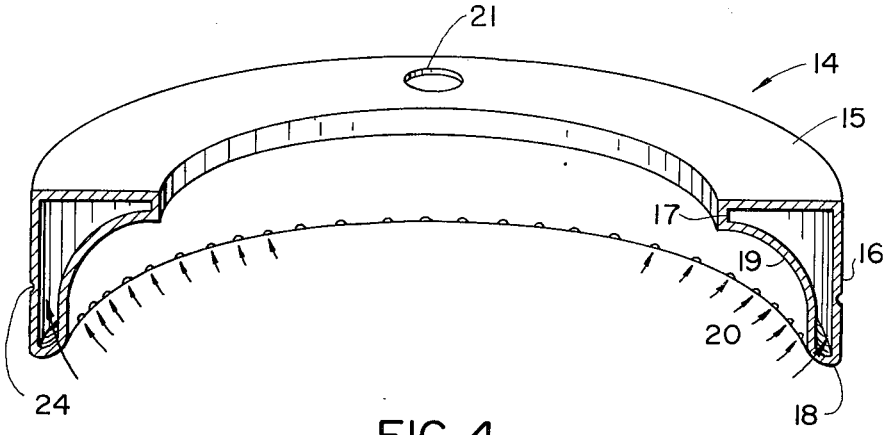
FIG. 4 is a perspective view of half of a circular conduit of one embodiment of the attachment.

The next element of the attachment which is added to the assembly is vacuum chamber 14 which is shown separately in FIG. 4. Vacuum chamber 14 is a hollow ring having a flat upper surface 15, a vertical outer wall 16 extends downwardly from flat upper surface 15. The inner edge of flat upper surface 15 of vacuum chamber 14 has an integral short vertical inner wall 17 extending downwardly therefrom. The inner diameter of vacuum chamber 14 is slightly greater than the outer diameter of base plate 6.

Extending inwardly from the bottom of vertical outer wall 16 of vacuum chamber 14 is a short convex curved portion 18. Connecting the bottom of short vertical inner wall 17 and short convex curved portion 18 is a long integral concave curved portion 19. A series of apertures 20 are formed in convex curved portion 18 of vacuum chamber 14. Accordingly, the openings 20 face at least partially inwardly, above the lower extent of the wall 16. It is apparent from FIGS. 1 and 6 that when the chamber 14 rests on a work surface, the openings 20 remain unobstructed, because they extend above the lower extent of the chamber 14. Flat upper surface 15 contains two large apertures 21 on opposite sides of vacuum chamber 14. These apertures 21 are connected by flexible tubes 22 and 23 to a vacuum source. A circumferential indentation 24 is formed in vertical outer wall 16 of vacuum chamber 14.

As mentioned earlier the vacuum chamber 14 is mounted against foam rubber ring 13 in such a manner that the flat upper surface 15 of the vacuum chamber 14 rests against the bottom of foam rubber ring 13.

A vacuum chamber retaining plate 25 having a flat portion 26 and downwardly and outwardly extending L-shaped flanges 27 is mounted against flat upper retaining plate 10. Vacuum chamber retaining plate 25 includes a series of bolt holes 28 adapted to receive bolts 9.

Base plate 6 is placed under vacuum chamber retaining plate 25 with the flanges 7 of base plate 6 resting directly against the upper portion of L-shaped flanges 27 of vacuum chamber retaining plate 25. Bolts 9 are then inserted through the aligned bolt holes in base plate 6, vacuum chamber retaining plate 25, and flat upper retaining plate 10 and the bolts 9 are threaded into the retaining means in the shell so that the attachment is mounted on the sander.

As seen in FIG. 1 bristles 29 are mounted about the outer circumference of vacuum chamber 14 and retained on the circumference by retaining means 30 which fits against circumferential indentation 24 in the vertical outer wall 16 of vacuum chamber 14.

Figure 2:
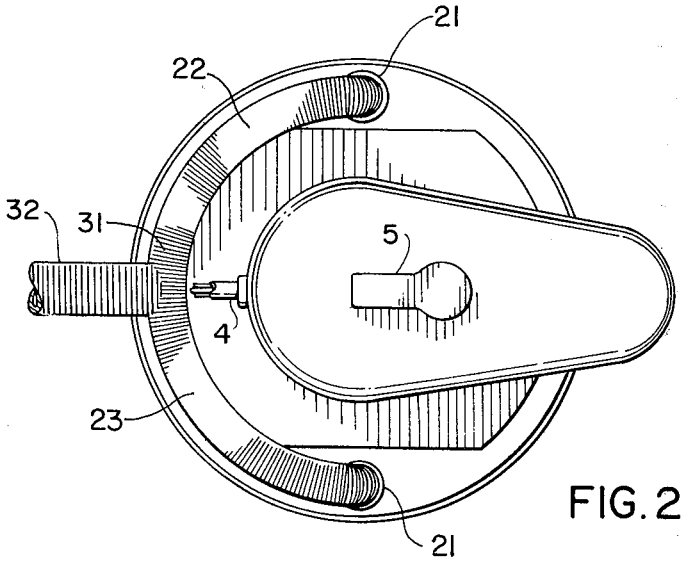
FIG. 2 is a plan view of the sander with one embodiment of the attachment mounted on the sander.
Figure 3:
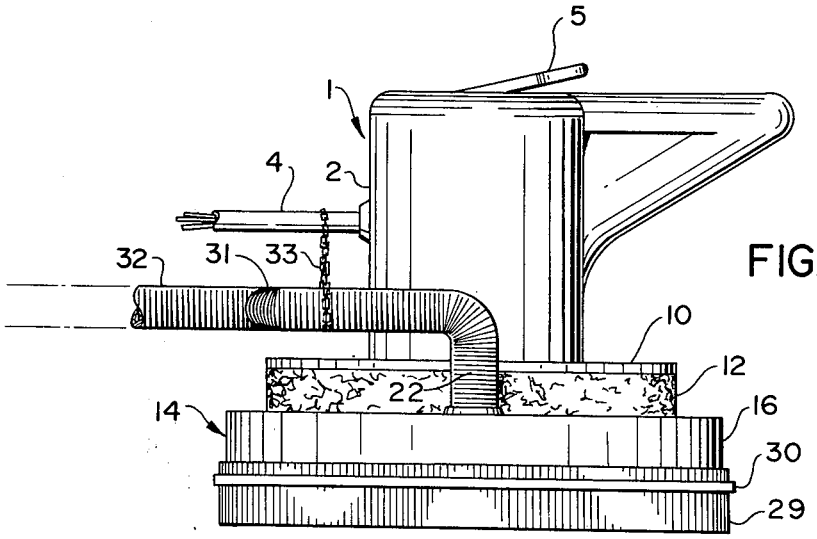
FIG. 3 is a side elevation view of a conventional sander with one embodiment of the attachment mounted on the sander.

Referring to FIG. 2 flexible tubes 22 and 23 are connected to vacuum chamber 14. The flexible tubes 22 and 23 proceed around shell 2 and are connected through a T 31 to inlet tube 32. As seen in FIG. 3 inlet tube 32 is supported by a chain 33 from power conduit 4.

Figure 5:
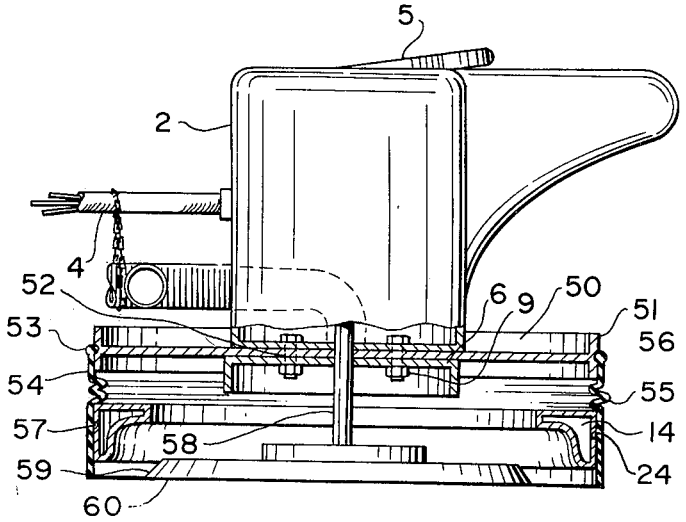
FIG. 5 is a side elevation cross-sectional view of a further embodiment of the attachment.

In FIG. 5 a second embodiment of the invention is disclosed. In this embodiment a suspending plate 50 having peripheral flanges 51 is placed next to the bottom of the shell 2. Suspending plate 50 has bolt holes 52 adapted to receive bolts 9. Peripheral flanges 51 contain a peripheral groove 53. Suspending plate 50 is maintained in position by base plate 6 which is applied below suspending plate 5, bolt holes in both plates are aligned, bolts 9 are inserted through the bolt holes in the respective plates and the plates are tightened against the shell 2.

A skirt 54 including accordian pleats 55 and upper ring 56 is placed over peripheral flange 52 so that the ring fastens into peripheral groove 54. Vacuum chamber 14 is fastened to the lower portion of skirt 54 by a lower ring 57 in skirt 54. The lower ring 57 is engaged in peripheral groove 24 of conduit 14. The skirt 54 extends below lower ring 57 so as to remain in contact with the work surface when in operation.

The shaft 58, sanding pad 59 and disc 60 are connected to motor 3 of sander 1.

In operation the sander 1 and attachment as shown in FIG. 1 will provide for relatively free movement of the vacuum chamber 14 relative to the sanding pad 59. As the sanding pad 59 is moved over flat, convex or concave surfaces the bristles 29 will ride over the work surface. The bristles 29 physically rub the work surface removing abraded material therefrom. The vacuum chamber 14 is limited in downward vertical movement as the inner vertical wall 17 and the upper portion of long integral curved portion 19 of the conduit are stopped by the horizontal part of L-shaped flanges 27 of conduit retaining plate 25. The vacuum chamber 14 is limited in upper movement by the circular foam rubber ring 12. The inner diameter of conduit 14 is greater than the outer diameter of vacuum abrader retaining plate 25 which enables the bottom of vacuum chamber 14 to assume an inclined position, so that the bristles 29 on the vacuum chamber 14 will generally follow concave or convex surfaces. The apertures 20 are retained in close proximity to the work surface and the edge of the sanding pad 59 throughout the sanding operation. By applying the vacuum through apertures 20 in the vacuum chamber 14 a suction will still be maintained on the surface being sanded even in those situations where an edge of a workpiece is being sanded.

The vacuum chamber 14 has been disclosed as consisting of a series of apertures 20 in the convex curved portion 18 of conduit 14. The vacuum source is disclosed as connected to flat upper surfaces 15 through two large apertures 20, 21 on opposite sides of vacuum chamber 14. It is apparent that variations in the number and placement of large apertures 20, 21 may be made without departing from the scope of this invention. Similarly the series of apertures 20 in the convex curved portion 18 of vacuum chamber 14 may be circular apertures, slots, small attachments extending downwardly from the circular apertures or slots, or a narrow slot about the bottom of the vacuum chamber 14.

While the applicant has disclosed the use of bristles 29 for attachment to the vacuum chamber 14 to clean the surface and limit the spraying of abraded materials it will be apparent that other materials such as felt, or rubber could also be used.

The embodiments disclosed may be used with orbital or spinning sanders. It will be apparent that this invention can be applied to other types of abrading devices by changing the shape of vacuum chamber 14 so that a vacuum will be applied to the workpiece at and near the edges of the abrader.

Abrading equipment manufactured by different manufacturers have different shells 2 and base plates 6. In order to apply the attachment of this invention to the abraders different manufacturers' changes in base plates and retaining plates will be made without departing from the scope of the invention.

I claim:

1. For a dry abrading machine that includes a work head mounted on a tool body which includes motor means for driving the work head in engagement with a work piece so as to remove particles from the work piece and to propel the removed particles outwardly of the work head, generally parallel to the surface of the work piece which is being addressed, a vacuum attachment, comprising:

a ring member incorporating an annular hollow chamber having a vacuum inlet conduit extending therefrom;

means defining a perimetrically extending series of individual apertures through the ring member, communicating the hollow chamber with the inner side of the exterior of the ring member, above the lowermost extent of the ring member;

an outer peripheral skirt of downwardly projecting scrubbing elements secured to the ring member so as to extend at least as low as the lowermost extent of the ring member, radially outside the communication of the apertures with the inner side of the exterior of the ring member, and disposed for scrubbing contact with the workpiece, to free particles which have been abraded from the work piece by the work head and to confine such particles so as to substantially prevent their escape until they are sucked up by said attachment;

retaining plate means including: a first portion having means thereon for securement thereof to the tool body; a second portion for extending generally axially from the first portion toward the work head, when the first portion is secured to the tool body; and a third, generally laterally extending portion;

said ring member including a generally radially extending portion;

a ring of resilient material generally coaxially received between the tool body and said generally radially extending portion of the ring member, the ring member radially extending portion being generally coaxially received between the ring of resilient material and said third, generally laterally extending portion of the retaining plate means;

the ring member generally radially extending portion lying radially adjacent the second portion of the retaining plate means, with radial spacing therebetween, whereby, when the attachment is mounted on the tool body, the ring member is disposed for limited axial and rocking movement to maintain the apertures spatially oriented to suck in said particles which have been abraded for the work piece and propelled outwardly of the work head or freed by the scrubbing contact of said scrubbing elements with the work piece.

2. The dry abrading machine vacuum attachment of claim 1 wherein the ring member radially extending portion extends radially inwardly and the third generally laterally extending portion of the retaining means extends radially outwardly; the second portion of the retaining plate means being generally tubular, and the ring of resilient material bridging the upper end of the radial spacing between said second portion and the ring member radially extending portion.

3. The dry abrading machine vacuum attachment of claim 1, wherein the scrubbing elements are constituted by bristles.

4. For a dry abrading machine that includes a disk-shaped work head mounted for spinning rotation on a tool body which includes motor means for driving the work head in abrading engagement with a surface of a work piece and to propel the removed particles radially outwardly of the spinning, disk-shaped work head, generally parallel to said surface of the work piece, a vacuum attachment comprising:

a ring member incorporating an annular hollow chamber having a vacuum inlet conduit extending therefrom;

means defining a perimetrically extending series of individual apertures through the ring member, communicating the hollow chamber with the inner side of the exterior of the ring member, above the lowermost extent of the ring member;

an outer peripheral skirt of downwardly projecting scrubbing elements secured to the ring member so as to extend at least as low as the lowermost extent of the ring member, radially outside the communication of the apertures with the inner side of the exterior of the ring member, and disposed for scrubbing contact with the work piece, to free particles which have been abraded from the work piece by the work head and to confine such particles so as to substantially prevent their escape until they are sucked up by said attachment;

retaining plate means including: a first portion having means thereon for securement thereof to the tool body; a second portion for extending generally axially from the first portion toward the work head, when the first portion is secured to the tool body; and a third, generally laterally extending portion;

said ring member including a generally radially extending portion;

a ring of resilient material generally coaxially received between the tool body and said generally raidially extending portion of the ring member, the ring member radially extending portion being generally coaxially received between the ring of resilient material and said third, generally laterally extending portion of the retaining plate means;

the ring member generally radially extending portion lying radially adjacent the second portion of the retaining plate means, with radial spacing therebetween, whereby, when the attachment is mounted on the tool body, the ring member is disposed for limited axial and rocking movement by engagement of the scrubbing elements with said surface of the work piece, to effect varying resilient compression of the ring of resilient material, to maintain the apertures in proper spatial orientation to suck in said particles which have been abraded from said surface of the work piece and propelled outwardly of the spinning, disk-shaped work head or freed by the scrubbing elements with the work piece.

5. For a dry abrading machine that includes a work head mounted on a tool body which includes motor means for driving the work head in engagement with a work piece so as to remove particles from the work piece and to propel the removed particles outwardly of the work head, generally parallel to the surface of the work piece which is being addressed, a vacuum attachment, comprising:

a ring member incorporating an annular hollow chamber having a vacuum inlet conduit extending therefrom, means defining a perimetrically extending series of individual apertures through the ring member, communicating the hollow chamber with the inner side of the exterior of the ring member, above the lowermost extent of the ring member;

the hollow chamber of generally triangular shape, increasing in width as it extends upwardly from the series of apertures, and having a lower end edge disposed adjacent but below said series of apertures as the lowermost extent of the ring member, the ring having an upper flat surface, a tubular outer wall and inner wall, means extending between the lower extent of the tubular outer wall and the inner extent of the upper flat surface, this inner wall means proceeding exteriorly convexly for a shorter axial distance from the lower extent of the tubular outer wall, then exteriorly concave for a longer axial distance to merge with surface means defining a central opening through the ring member where the inner wall means adjoins the inner extent of the upper flat surface;

an outer peripheral skirt of downwardly projecting scrubbing elements secured to the ring member so as to extend as least as low as the lowermost extent of the ring member, radially outside the communication of the apertures with the inner side of the exterior of the ring member, and disposed for scrubbing contact with the work piece, to free particles which have been abraded from the work piece by the work head and to confine such particles so as to substantially prevent their escape until they are sucked up by said attachment;

retainer means securable to the tool body for supporting the ring member and for providing for limited axial and rocking movement of the ring member axially forwardly of the tool body;

resilient material interposed for action between the tool body and the ring member and tending to resiliently resist movement of the ring member toward the tool body, whereby, when the attachment is mounted on the tool body, the ring member is disposed for limited axial and rocking movement to maintain the apertures spatially oriented to suck in said particles which have been abraded from the work piece and propelled outwardly of the work head or freed by the scrubbing contact of said scrubbing elements with the work piece.

6. The dry abrading machine vacuum attachment of claim 5, wherein the resilient material is constituted by a ring of foamed resilient plastic material.

7. The dry abrading machine vacuum attachment of claim 5, wherein the resilient material and the retaining means are comprised of a tubular rubbery skirt having a band of circumferentially extending accordian pleats in a region thereof intermediate the ends thereof;

one end thereof including means for securing that end to the tool body and the tubular rubbery skirt, below said band of accordian pleats thereof including means for securing that skirt to the ring member, about the circumference of each.

8. The dry abrading machine vacuum attachment of claim 7, wherein the means for securing said one end to the tool body includes a suspending plate; means for securing the suspending plate to the tool body; and means for circumferentially securing said one end to the suspending plate, circumferentially thereof.

9. The dry abrading machine vacuum attachment of claim 8 wherein the means for circumferentially securing said one end to the suspending plate circumferentially thereof, comprises: means defining a circumferentially extending enlarged bead on said one end and means defining a corresponding groove, for receipt of said bead, on the suspending plate.

10. The dry abrading machine vacuum attachment of claim 7 wherein the means for circumferentially securing said other end to the ring member including means defining circumferentially extending enlarged bead on the tubular rubbery skirt below the band of accordian pleats; and means defining a corresponding groove, for receipt of said bead, on the ring member.

11. For a dry abrading machine that includes a work head mounted on a tool body which includes motor means for driving the work head in engagement with a work piece so as to remove particles from the work piece and to propel the removed particles outwardly of the work head, generally parallel to the surface of the work piece which is being addressed, a vacuum attachment, comprising:

a ring member incorporating an annular hollow chamber having a vacuum inlet conduit extending therefrom;

means defining a perimetrically extending series of individual apertures through the ring member, communicating the hollow chamber with the inner side of the exterior of the ring member, above the lowermost extent of the ring member;

an outer peripheral skirt of downwardly projecting scrubbing elements secured to the ring member so as to extend at least as low as the lowermost extent of the ring member, radially outside the communication of the apertures with the inner side of the exterior of the ring member, and disposed for scrubbing contact with the work piece, to free particles which have been abraded from the work piece by the work head and to confine such particles so as to substantially prevent their escape until they are sucked up by said attachment;

retainer means securable to the tool body for supporting the ring member and for providing for limited axial and rocking movement of the ring member axially forwardly of the tool body;

resilient material interposed for action between the tool body and the ring member and tending to resiliently resist movement of the ring member toward the tool body, the resilient material and the retaining means being comprised of a tubular rubbery skirt having a band of circumferentially extending accordian pleats in a region thereof intermediate the ends thereof;

one end thereof including means for securing that end to the tool body and the tubular rubber skirt, below said band of accordian pleats thereof including means for securing that skirt to the ring member, about the circumference of each, the means for circumferentially securing said other end to the ring member includes means defining a circumferentially extending enlarged bead on the tubular rubbery skirt below the band of accordian pleats; and means defining a corresponding groove, for receipt of said bead, on the ring member, the tubular rubbery skirt extending below the lower extent of the ring member to constitute said outer peripheral skirt of downwardly projecting scrubbing elements.

12. A dry abrading machine, including:

a work head;

a tool body;

means for mounting a work head on the body;

motor means on the tool body for driving the work head mounting means, to drive the work head, when so mounted, in engagement with a work piece so as to remove particles from the work piece and to propel the removed particles outwardly of the work head, generally parallel to the surface of the work piece which is being addressed, means for vacuuming-up said particles, comprising:

a ring member incorporating an annular hollow chamber having a vacuum inlet conduit extending therefrom;

means defining a perimetrically extending series of individual apertures through the ring member, communicating the hollow chamber with the inner side of the exterior of the ring member, above the lowermost extent of the ring member;

an outer peripheral skirt of downwardly projecting scrubbing elements secured to the ring member so as to extend at least as low as the lowermost extent of the ring member, radially outside the communication of the apertures with the inner side of the exterior of the ring member, and disposed for scrubbing contact with the work piece, to free particles which have been abraded from the work piece by the work head and to confine such particles so as to substantially prevent their escape until they are sucked up by said vacuuming-up means;

retaining plate means including: a first portion having means thereon securing the retaining plate means to the tool body; a second portion extending generally axially from the first portion toward the work head; and a third, generally laterally extending portion, said ring member including a generally radially extending portion;

a ring of resilient material generally coaxially received between the tool body and said generally radially extending portion of the ring member, the ring member radially extending portion being generally coaxially received between the ring of resilient material and said third, generally laterally extending portion of the retaining plate means;

the ring member generally radially extending portion lying radially adjacent the second portion of the retaining plate means, with radial spacing therebetween, whereby, the ring member is disposed for limited axial and rocking movement to maintain the apertures spatially oriented to suck in said particles which have been abraded from the work piece and propelled outwardly of the work head or freed by the scrubbing contact of said scrubbing elements with the work piece.

13. The dry abrading machine of claim 12, wherein the ring member radially extending portion extends radially inwardly and the third generally laterally extending portion of the retaining means extends radially outwardly; the second portion of the retaining plate means being generally tubular; and the ring of resilient material bridging the upper end of the radial spacing between said second portion and the ring member radially extending portion.

14. The dry abrading machine of claim 12, wherein the scrubbing elements are constituted by bristles.

15. The dry abrading machine of claim 12, wherein the work head is disk-shaped with means for retention thereon of an abrasive disk surface means for presentation in abrading engagement with a surface of the work piece;

wherein the means for mounting the work head on the body rotatably mounts the work head; and wherein the motor means rotatably drives the work head.

16. The dry abrading machine of claim 15 further including sanding abrasive disk surface means mounted by said retention means on said retention means on said disk-shaped work head.

17. The dry abrading machine of claim 15 further including grinding abrasive disk surface means mounted by said retention means on said disk-shaped work head.

18. A dry abrading machine, including:

a work head;

a tool body;

means for mounting a work head on the body;

motor means on the tool body for driving the work head mounting means, to drive the work head, when so mounted, in engagement with a work piece so as to remove particles from the work piece and to propel the removed particles outwardly of the work head, generally parallel to the surface of the work piece which is being addressed, means for vacuuming-up said particles, comprising:

a ring member incorporating an annular hollow chamber having a vacuum inlet conduit extending therefrom, the hollow chamber being of generally triangular shape, increasing in width as it extends upwardly from the series of apertures, and having a lower end edge disposed adjacent but below said series of apertures as the lowermost extent of the ring member, the ring having an upper flat surface, a tubular outer wall and inner wall means extending between the lower extent of the tubular outer wall and the inner extent of the upper flat surface, this inner wall means proceeding exteriorly convexly for a shorter axial distance from the lower extent of the tubular outer wall, then exteriorly concave for a longer axial distance to merge with surface means defining a central opening through the ring member where the inner wall means adjoins the inner extent of the upper flat surface;

means defining a perimetrically extending series of individual apertures through the ring member, communicating the hollow chamber with the inner side of the exterior of the ring member, above the lowermost extent of the ring member;

an outer peripheral skirt of downwardly projecting scrubbing elements secured to the ring member so as to extend at least as low as the lowermost extent of the ring member, radially outside the communication of the apertures with the inner side of the exterior of the ring member, and disposed for scrubbing contact with the work piece, to free particles which have been abraded from the work piece by the work head and to confine such particles so as to substantially prevent their escape until they are sucked up by said vacuuming-up means;

retainer means secured to the tool body, supporting the ring member and providing limited axial and rocking movement of the ring member axially forwarding of the tool body;

resilient material interposed for action between the tool body and the ring member and tending to resiliently resist movement of the ring member toward the tool body, whereby, the ring member is disposed for limited axial and rocking movement to maintain the apertures spatially oriented to suck in said particles which have been abraded from the work piece and propelled outwardly of the work head or freed by the scrubbing contact of said scrubbing elements with the work piece.

19. The dry abrading machine of claim 18, wherein the resilient material is constituted by a ring foamed resilient plastic material.

* * * * *